US011145249B1

(12) United States Patent
Han et al.

(10) Patent No.: US 11,145,249 B1
(45) Date of Patent: Oct. 12, 2021

(54) DISPLAY WITH OPTICAL SENSOR FOR BRIGHTNESS COMPENSATION

(71) Applicant: Apple Inc., Cupertino, CA (US)

(72) Inventors: Wanglei Han, Fremont, CA (US); Akshay Bhat, Milpitas, CA (US); Michael H. Lim, Cupertino, CA (US); Kyung Hoae Koo, San Jose, CA (US); Jiayi Jin, Redwood City, CA (US); David A. Doyle, Cupertino, CA (US); Tae-Wook Koh, San Jose, CA (US); Jared S. Price, San Jose, CA (US); Yifan Zhang, San Carlos, CA (US); Mahdi Nezamabadi, San Jose, CA (US)

(73) Assignee: Apple Inc.

( * ) Notice: Subject to any disclaimer, the term of this patent is extended or adjusted under 35 U.S.C. 154(b) by 0 days.

(21) Appl. No.: 16/930,204

(22) Filed: Jul. 15, 2020

(30) Foreign Application Priority Data

Jun. 28, 2020 (CN) ..... 202010597167.6

(51) Int. Cl.
*G09G 3/3225* (2016.01)
*G09G 3/00* (2006.01)

(52) U.S. Cl.
CPC ..... *G09G 3/3225* (2013.01); *G09G 3/006* (2013.01); *G09G 2320/0233* (2013.01); *G09G 2320/045* (2013.01); *G09G 2320/046* (2013.01)

(58) Field of Classification Search
CPC ..... G09G 3/3225; G09G 3/006; G09G 2320/045; G09G 2320/046; G09G 2320/0233
See application file for complete search history.

(56) References Cited

U.S. PATENT DOCUMENTS 7,864,136 B2 * 1/2011 Matthies ..... G02F 1/13336 345/1.3
8,589,100 B2 * 11/2013 Chaji ..... G09G 3/32 702/64

(Continued)

FOREIGN PATENT DOCUMENTS

CN 101714327 A 5/2010
CN 104575382 A 4/2015

(Continued)

*Primary Examiner* — Amy Onyekaba
(74) *Attorney, Agent, or Firm* — Treyz Law Group, P.C.; Joseph F. Guihan

(57) ABSTRACT

A display may include pixels (such as light-emitting diode pixels) that are susceptible aging effects (burn-in). To help avoid visible artifacts caused by burn-in during operation of the display, compensation circuitry may be used to compensate image data for the display. An optical sensor may be included behind the pixels to directly measure pixel brightness levels. The optical sensor may provide optical sensor data from testing operations to the compensation circuitry. The optical sensor may gather data during burn-in testing operations. During the burn-in testing operations, pixel groups including both high-usage pixels and low-usage pixels may sequentially emit light while the optical sensor gathers data. Brightness differences between the high-usage pixels and low-usage pixels may be used to characterize pixel aging in the display and compensate image data to mitigate visible artifacts caused by burn-in. The optical sensor may also gather data during global brightness testing operations.

18 Claims, 14 Drawing Sheets

(56) References Cited

U.S. PATENT DOCUMENTS 8,599,223 B2 * 12/2013 Hasegawa ..... G09G 3/3233 345/690
9,058,769 B2 * 6/2015 Bert ..... G09G 3/3208
9,875,685 B2 * 1/2018 Kwon ..... G09G 3/3208
10,022,045 B1 * 7/2018 Evans ..... A61B 3/032
10,157,590 B1 * 12/2018 Aflatooni ..... G06K 9/00013
10,565,419 B2 * 2/2020 Ryu ..... G02B 6/0091
10,679,030 B2 * 6/2020 Shepelev ..... G09G 3/2007
10,817,018 B1 * 10/2020 Shao ..... G06F 1/1637
2003/0006980 A1 * 1/2003 Brabander ..... G02F 1/13318 345/207
2003/0043107 A1 * 3/2003 Ruby ..... G09G 3/3406 345/102
2006/0038807 A1 * 2/2006 Eckhardt ..... H04N 5/58 345/207
2007/0055143 A1 * 3/2007 Deroo ..... G09G 3/006 600/425
2009/0040140 A1 * 2/2009 Scheibe ..... G09G 3/006 345/46
2009/0040152 A1 * 2/2009 Scheibe ..... G06F 3/1446 345/82
2009/0040153 A1 * 2/2009 Scheibe ..... G09G 3/2003 345/83
2009/0040197 A1 * 2/2009 Scheibe ..... G09G 3/14 345/204
2009/0040775 A1 * 2/2009 Scheibe ..... G09F 9/33 362/373
2010/0053045 A1 * 3/2010 Fish ..... G09G 3/3233 345/82
2010/0073341 A1 * 3/2010 Toyooka ..... G09G 3/3614 345/208
2010/0201275 A1 * 8/2010 Cok ..... G09G 3/3225 315/158
2010/0253660 A1 * 10/2010 Hashimoto ..... G01J 1/42 345/207
2011/0043486 A1 * 2/2011 Hagiwara ..... G06F 3/042 345/175
2011/0098957 A1 * 4/2011 Zaidi ..... G01J 3/027 702/85
2012/0050685 A1 * 3/2012 Bartlett ..... A61B 3/111 351/223
2012/0086344 A1 * 4/2012 Schuch ..... G09G 3/3406 315/152
2013/0278578 A1 * 10/2013 Vetsuypens ..... G09G 5/02 345/207
2014/0152632 A1 * 6/2014 Shedletsky ..... G01J 1/4204 345/207
2014/0152706 A1 * 6/2014 Park ..... H04N 1/6052 345/690
2014/0192208 A1 * 7/2014 Okincha ..... H04N 17/002 348/188
2014/0292997 A1 * 10/2014 Hung ..... H04N 7/141 348/14.01
2014/0340286 A1 * 11/2014 Machida ..... G02B 27/0172 345/8
2015/0022098 A1 * 1/2015 Knapp ..... G09G 3/2018 315/161
2015/0097820 A1 * 4/2015 An ..... G09G 3/3208 345/207
2015/0177256 A1 * 6/2015 Elder ..... G01N 27/3273 348/158
2016/0078594 A1 * 3/2016 Scherlen ..... G06F 16/23 345/428
2016/0119617 A1 * 4/2016 Sagar ..... H04N 5/23222 348/187
2017/0034519 A1 * 2/2017 Rosewarne ..... H04N 19/85
2017/0076661 A1 * 3/2017 Zhang ..... G09G 3/2003
2017/0092228 A1 * 3/2017 Cote ..... G09G 3/3225
2018/0075798 A1 * 3/2018 Nho ..... G09G 3/32
2018/0084990 A1 * 3/2018 Evans ..... A61B 3/032
2018/0190214 A1 * 7/2018 Kim ..... G09G 3/3413
2018/0242242 A1 * 8/2018 Lee ..... H04W 68/00
2018/0247588 A1 * 8/2018 Lee ..... G09G 3/3225
2018/0322845 A1 * 11/2018 Machida ..... G02B 26/026
2018/0350295 A1 * 12/2018 Drzaic ..... G06F 3/0643
2018/0357460 A1 * 12/2018 Smith ..... H01L 27/3227
2019/0114458 A1 * 4/2019 Cho ..... G06K 9/2027
2019/0155337 A1 * 5/2019 Ohkawa ..... G02B 6/005
2019/0206365 A1 * 7/2019 Yin ..... G09G 3/3406
2019/0385572 A1 * 12/2019 Zhang ..... G09G 3/3208
2020/0098318 A1 * 3/2020 Liu ..... G09G 3/3233
2020/0105183 A1 * 4/2020 Dodson ..... G02B 27/281
2020/0118456 A1 * 4/2020 Breed ..... G06K 9/00617
2020/0146546 A1 * 5/2020 Chene ..... A61B 3/06
2020/0159030 A1 * 5/2020 Ayres ..... G02B 5/32
2020/0294468 A1 * 9/2020 Hung ..... H04B 10/516
2020/0301150 A1 * 9/2020 Breed ..... G02B 27/0172
2020/0342800 A1 * 10/2020 Li ..... G06F 1/1637
2020/0348790 A1 * 11/2020 Vampola ..... G09G 3/3406
2020/0372877 A1 * 11/2020 Weindorf ..... H04N 5/58
2021/0020101 A1 * 1/2021 Van Eessen ..... G09G 3/006
2021/0116392 A1 * 4/2021 Fitzgerald ..... G01N 21/956
2021/0233491 A1 * 7/2021 Lee ..... G09G 5/10

FOREIGN PATENT DOCUMENTS

CN 107589657 A 1/2018
CN 109697954 A 4/2019
CN 111276522 A 6/2020

* cited by examiner

DISPLAY WITH OPTICAL SENSOR FOR BRIGHTNESS COMPENSATION

This application claims priority to CN patent application No. 202010597167.6, filed on Jun. 28, 2020, which is hereby incorporated by reference herein in its entirety.

BACKGROUND

This relates generally to electronic devices, and, more particularly, to electronic devices with displays.

Electronic devices often include displays. For example, an electronic device may have a light-emitting diode (LED) display based on light-emitting diode pixels. In this type of display, each pixel includes a light-emitting diode and thin-film transistors for controlling application of a signal to the light-emitting diode to produce light. The light-emitting diodes may include OLED layers positioned between an anode and a cathode. To emit light from a given pixel in a light-emitting diode display, a voltage may be applied to the anode of the given pixel.

It is within this context that the embodiments herein arise.

SUMMARY

An electronic device such as a wristwatch device or other device may have a display. The display may be used to display information such as watch face information. For example, a watch face image may be displayed continuously on the display during operation of the wristwatch device.

The watch face image on the display may contain watch face elements such as watch face hands, watch face indices (tick marks), and watch face complications. The display may include an array of pixels. The pixels may be light-emitting diode pixels that are susceptible aging effects (burn-in). To help avoid visible artifacts caused by burn-in during operation of the display, compensation circuitry may be used to compensate image data for the display.

An optical sensor may be included in the display to directly measure pixel brightness levels. The optical sensor may provide optical sensor data from testing operations to the compensation circuitry. The compensation circuitry may in turn use the optical sensor data (in addition to usage history information) to compensate image data for the display.

The optical sensor may gather data during burn-in testing operations. During the burn-in testing operations, pixel groups including both high-usage pixels and low-usage pixels may sequentially emit light while the optical sensor gathers data. Brightness differences observed by the optical sensor between the high-usage pixels and low-usage pixels may be used to characterize pixel aging in the display and compensate image data to mitigate visible artifacts caused by burn-in.

The optical sensor may also gather data during global brightness testing operations. During the global brightness testing operations, a predetermined test pattern may be displayed. The optical sensor may be used to detect a brightness drop in the display over time based on the brightness of the predetermined test pattern. This information may also be used by the compensation circuitry to compensate image data for the display.

DETAILED DESCRIPTION

Figure 1:
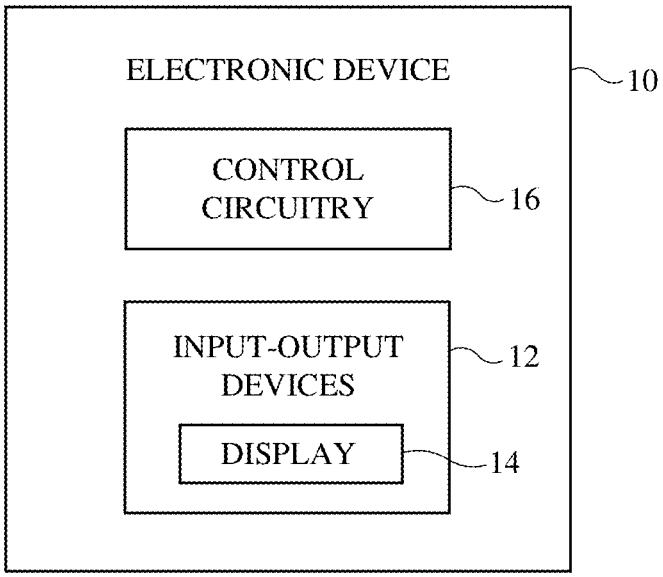
FIG. 1 is a schematic diagram of an illustrative electronic device having a display in accordance with an embodiment.

An illustrative electronic device of the type that may be provided with a display is shown in FIG. 1. Electronic device 10 may be a computing device such as a laptop computer, a computer monitor containing an embedded computer, a tablet computer, a cellular telephone, a media player, or other handheld or portable electronic device, a smaller device such as a wristwatch device, a pendant device, a headphone or earpiece device, a device embedded in eyeglasses or other equipment worn on a user's head, or other wearable or miniature device, a display, a computer display that contains an embedded computer, a computer display that does not contain an embedded computer, a gaming device, a navigation device, an embedded system such as a system in which electronic equipment with a display is mounted in a kiosk or automobile, or other electronic equipment. Electronic device 10 may have the shape of a pair of eyeglasses (e.g., supporting frames), may form a housing having a helmet shape, or may have other configurations to help in mounting and securing the components of one or more displays on the head or near the eye of a user.

As shown in FIG. 1, electronic device 10 may include control circuitry 16 for supporting the operation of device 10. Control circuitry 16 may include storage such as hard disk drive storage, nonvolatile memory (e.g., flash memory or other electrically-programmable-read-only memory configured to form a solid state drive), volatile memory (e.g., static or dynamic random-access memory), etc. Processing circuitry in control circuitry 16 may be used to control the operation of device 10. The processing circuitry may be based on one or more microprocessors, microcontrollers, digital signal processors, baseband processors, power management units, audio chips, application-specific integrated circuits, etc.

Input-output circuitry in device 10 such as input-output devices 12 may be used to allow data to be supplied to device 10 and to allow data to be provided from device 10 to external devices. Input-output devices 12 may include buttons, joysticks, scrolling wheels, touch pads, key pads, keyboards, microphones, speakers, tone generators, vibrators, cameras, sensors, light-emitting diodes and other status indicators, data ports, etc. A user can control the operation of device 10 by supplying commands through input resources of input-output devices 12 and may receive status information and other output from device 10 using the output resources of input-output devices 12.

Input-output devices 12 may include one or more displays such as display 14. Display 14 may be a touch screen display that includes a touch sensor for gathering touch input from a user or display 14 may be insensitive to touch. A touch sensor for display 14 may be based on an array of capacitive touch sensor electrodes, acoustic touch sensor structures, resistive touch components, force-based touch sensor structures, a light-based touch sensor, or other suitable touch sensor arrangements. A touch sensor for display 14 may be formed from electrodes formed on a common display substrate with the display pixels of display 14 or may be formed from a separate touch sensor panel that overlaps the pixels of display 14. If desired, display 14 may be insensitive to touch (i.e., the touch sensor may be omitted). Display 14 in electronic device 10 may be a head-up display that can be viewed without requiring users to look away from a typical viewpoint or may be a head-mounted display that is incorporated into a device that is worn on a user's head. If desired, display 14 may also be a holographic display used to display holograms.

Control circuitry 16 may be used to run software on device 10 such as operating system code and applications. During operation of device 10, the software running on control circuitry 16 may display images on display 14.

Display 14 may be an organic light-emitting diode display, a display formed from an array of discrete light-emitting diodes each formed from a crystalline semiconductor die, or any other suitable type of display. Configurations in which the pixels of display 14 include light-emitting diodes are sometimes described herein as an example. This is, however, merely illustrative. Any suitable type of display may be used for device 10, if desired (e.g., a liquid crystal display).

In some cases, electronic device 10 may be a wristwatch device. Display 14 of the wristwatch device may be positioned in a housing. A wristwatch strap may be coupled to the housing.

Figure 2:
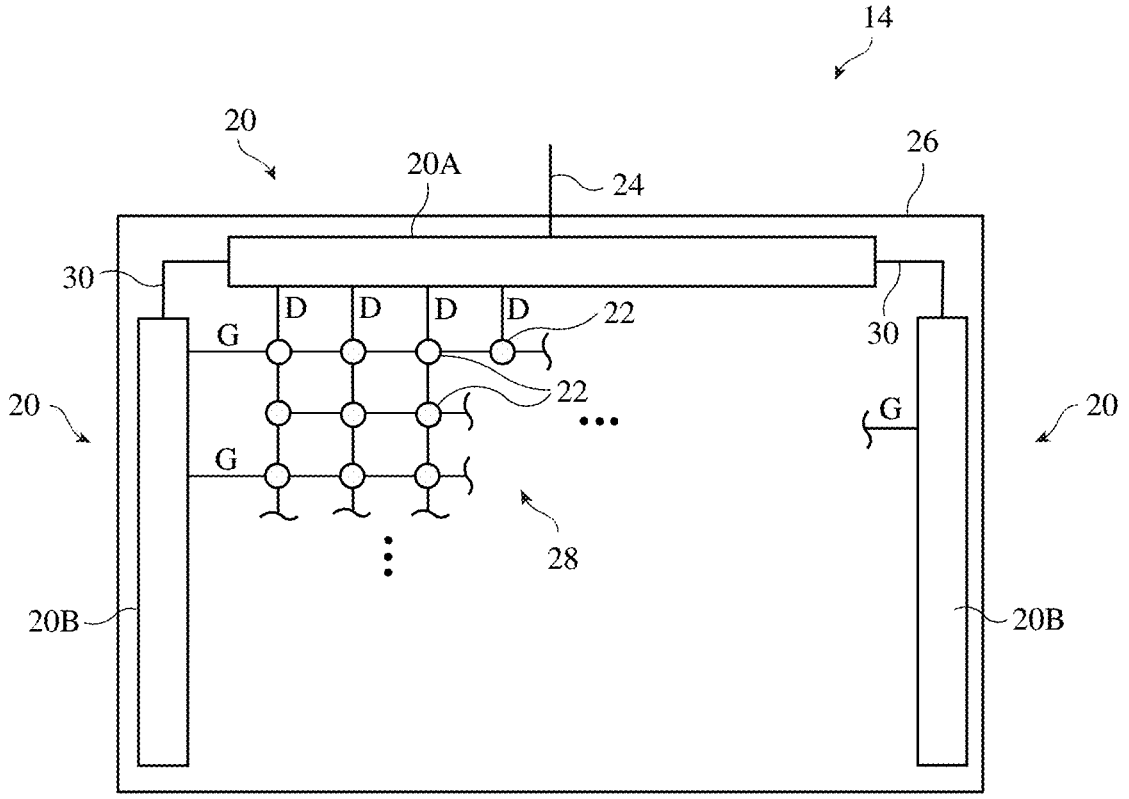
FIG. 2 is a schematic diagram of an illustrative display in accordance with an embodiment.

FIG. 2 is a diagram of an illustrative display 14. As shown in FIG. 2, display 14 may include layers such as substrate layer 26. Substrate layers such as layer 26 may be formed from rectangular planar layers of material or layers of material with other shapes (e.g., circular shapes or other shapes with one or more curved and/or straight edges). The substrate layers of display 14 may include glass layers, polymer layers, silicon layers, composite films that include polymer and inorganic materials, metallic foils, etc.

Display 14 may have an array of pixels 22 for displaying images for a user such as pixel array 28. Pixels 22 in array 28 may be arranged in rows and columns. The edges of array 28 may be straight or curved (i.e., each row of pixels 22 and/or each column of pixels 22 in array 28 may have the same length or may have a different length). There may be any suitable number of rows and columns in array 28 (e.g., ten or more, one hundred or more, or one thousand or more, etc.). Display 14 may include pixels 22 of different colors. As an example, display 14 may include red pixels, green pixels, and blue pixels. Pixels of other colors such as cyan, magenta, and yellow might also be used.

Display driver circuitry 20 may be used to control the operation of array 28. Display driver circuitry 20 may be formed from integrated circuits, thin-film transistor circuits, and/or other suitable circuitry. Illustrative display driver circuitry 20 of FIG. 2 includes display driver circuitry 20A and additional display driver circuitry such as gate driver circuitry 20B. Gate driver circuitry 20B may be formed along one or more edges of display 14. For example, gate driver circuitry 20B may be arranged along the left and right sides of display 14 as shown in FIG. 2.

As shown in FIG. 2, display driver circuitry 20A (e.g., one or more display driver integrated circuits, thin-film transistor circuitry, etc.) may contain communications circuitry for communicating with system control circuitry over signal path 24. Path 24 may be formed from traces on a flexible printed circuit or other cable. The control circuitry may be located on one or more printed circuits in electronic device 10. During operation, control circuitry (e.g., control circuitry 16 of FIG. 1) may supply circuitry such as a display driver integrated circuit in circuitry 20 with image data for images to be displayed on display 14. Display driver circuitry 20A of FIG. 2 is located at the top of display 14. This is merely illustrative. Display driver circuitry 20A may be located at both the top and bottom of display 14 or in other portions of device 10.

To display the images on pixels 22, display driver circuitry 20A may supply corresponding image data to data lines D while issuing control signals to supporting display driver circuitry such as gate driver circuitry 20B over signal paths 30. With the illustrative arrangement of FIG. 2, data lines D run vertically through display 14 and are associated with respective columns of pixels 22.

Gate driver circuitry 20B (sometimes referred to as gate line driver circuitry or horizontal control signal circuitry) may be implemented using one or more integrated circuits and/or may be implemented using thin-film transistor circuitry on substrate 26. Horizontal control lines G (sometimes referred to as gate lines, scan lines, emission control lines, etc.) run horizontally across display 14. Each gate line G is associated with a respective row of pixels 22. If desired, there may be multiple horizontal control lines such as gate lines G associated with each row of pixels. Individually controlled and/or global signal paths in display 14 may also be used to distribute other signals (e.g., power supply signals, etc.).

Gate driver circuitry 20B may assert control signals on the gate lines G in display 14. For example, gate driver circuitry 20B may receive clock signals and other control signals from circuitry 20A on paths 30 and may, in response to the received signals, assert a gate line signal on gate lines G in sequence, starting with the gate line signal G in the first row of pixels 22 in array 28. As each gate line is asserted, data from data lines D may be loaded into a corresponding row of pixels. In this way, control circuitry such as display driver circuitry 20A and 20B may provide pixels 22 with signals that direct pixels 22 to display a desired image on display 14. Each pixel 22 may have a light-emitting diode and circuitry (e.g., thin-film circuitry on substrate 26) that responds to the control and data signals from display driver circuitry 20.

Gate driver circuitry 20B may include blocks of gate driver circuitry such as gate driver row blocks. Each gate driver row block may include circuitry such output buffers and other output driver circuitry, register circuits (e.g., registers that can be chained together to form a shift register), and signal lines, power lines, and other interconnects. Each gate driver row block may supply one or more gate signals to one or more respective gate lines in a corresponding row of the pixels of the array of pixels in the active area of display 14.

It may be desirable to display information on display 14 for prolonged periods of time. For example, when device 10 is a wristwatch, it may be desirable to continuously or nearly continuously display a watch face image on display 14 whenever device 10 is in operation and being worn by a user. By displaying the watch face image for prolonged periods of time (e.g., in an uninterrupted stretch of at least 100 seconds, at least 10 minutes, at least 100 minutes, at least 10 hours, at least 100 hours, less than 50 hours, or other extended time period), a user of device 10 will be conveniently provided with watch face information and will not need to make any particular motions (e.g., a wrist motion) to turn on the watch face (e.g., the watch face may be displayed continuously rather than momentarily in response to user physical activity measured with an accelerometer or other motion sensor). The presence of the continuously displayed watch face image on device 10 may also enhance the appearance of device 10.

When displaying a watch face image for an extended period of time, however, there is a risk of burn-in effects in which the pixels of display 14 degrade due to wear. Pixel wear may be experienced, for example, when a pixel is operated at a high luminance for an extended period of time. Pixel wear (sometimes referred to as pixel aging) may be experienced differently for different colors of subpixels. For example, a red pixel (sometimes referred to as a red subpixel) may wear at a different rate than blue and green pixels (subpixels). Pixel wear may be non-linear as a function of output light intensity. For example, a pixel operated at a luminance L for a time period T may experience more than twice as much wear as a pixel operated at a luminance L/2 for the time period T. Pixel wear may be cumulative as a function of operating time. For example, a pixel that is operated at three successive disjoint time periods T may wear the same amount as a pixel that is operated for a single period of length 3T.

Based on these considerations, visible burn-in effects can be reduced or eliminated. For example, burn-in effects can be reduced or eliminated by tracking pixel usage over time and compensating for the usage of each pixel. This type of predictive compensation may mitigate visible burn-in effects in the display. Additional mitigation of visible burn-in effects in the display may be achieved by actively measuring burn-in effects using an optical sensor. An optical sensor may be positioned beneath the display and may detect differences in brightness levels between different pixels. The optical sensor data may therefore be used for active compensation of burn-in effects.

Figure 3:
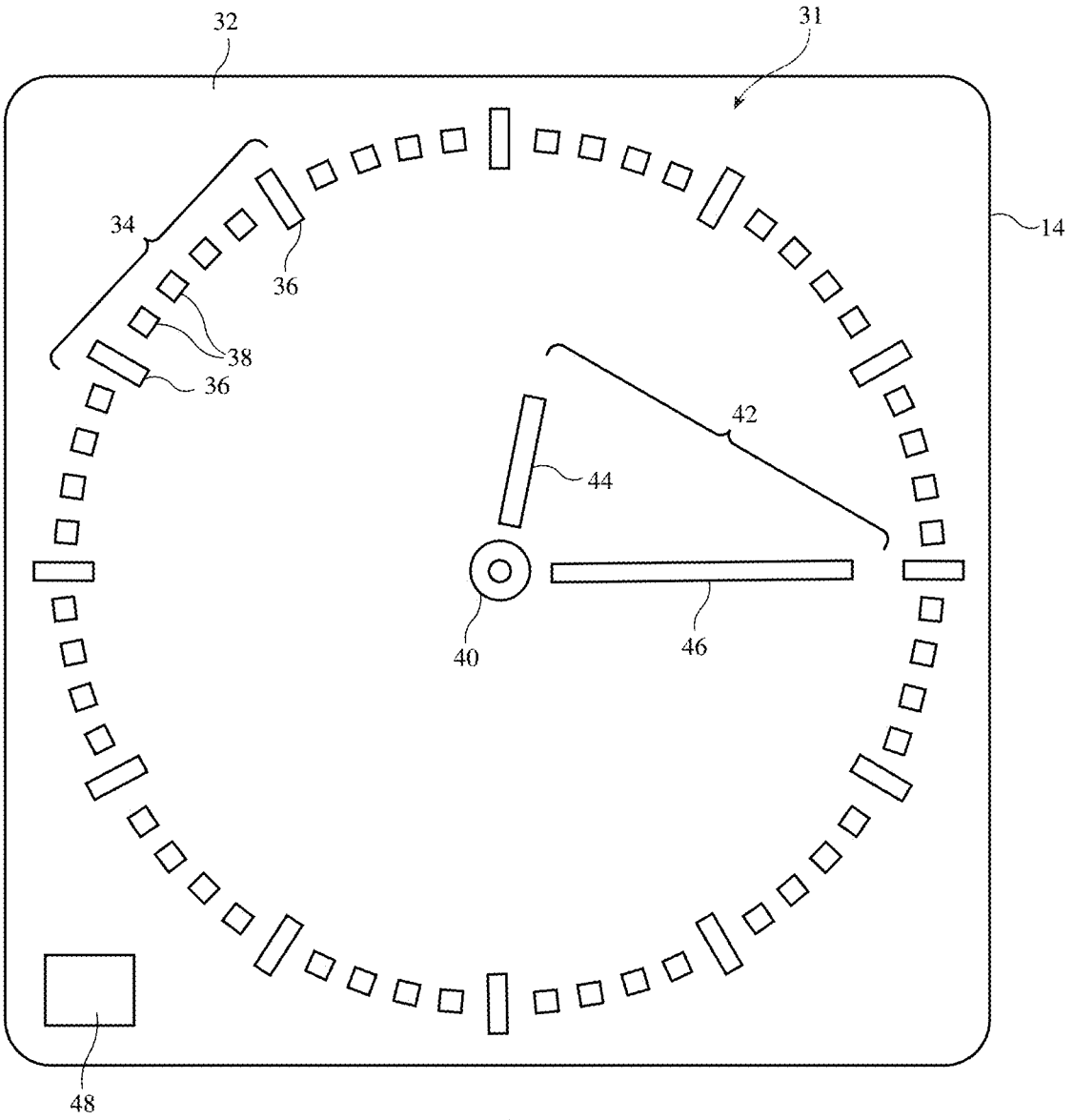
FIG. 3 is a diagram of an illustrative watch face displayed on a display in accordance with an embodiment.

Consider, as an example, the illustrative watch face image of FIG. 3. As shown in FIG. 3, watch face image 31 may include a background such as background 32. Background 32 may be black, may have a non-neutral color (e.g., red, green, blue, yellow, etc.), may be gray, may be white, may contain a static or moving image such as a picture of a person, a graphic image (e.g., a cartoon), a camera image, a decorative pattern, or other suitable background content. Use of dark background colors such as black or dark gray may help reduce power consumption.

Watch face image 31 may also contain time indices 34 such as hour indices 36 and minute indices 38. Indices 34, which may sometimes be referred to as tick marks, may be used to help denote the locations of the hours of the day. If desired, indices 34 may contain associated hour markers (e.g., "3" to label the 3:00 tick mark on the watch face, etc.). Watch face image 31 has hands 42 such as minute hand 46, hour hand 44, and, if desired, a second hand. Hands 42 move around central watch face element 40 (e.g., in a clockwise direction) so that the positions of hands 42 can be compared to the positions of indices 34 and thereby used to indicate the current time of day. If desired, watch face image 31 may also contain complications such as complication 48 or other ancillary content. Complication 48 may include weather information, a selectable icon, temperature information, a countdown timer, a selectable button for launching an application, flight status information, stock prices, sports scores, and/or other information. This information may be displayed at the corners of display 14, in the center of display (e.g., inside the ring formed by indices 34), and/or at other suitable locations within watch face image 31.

Figure 4:
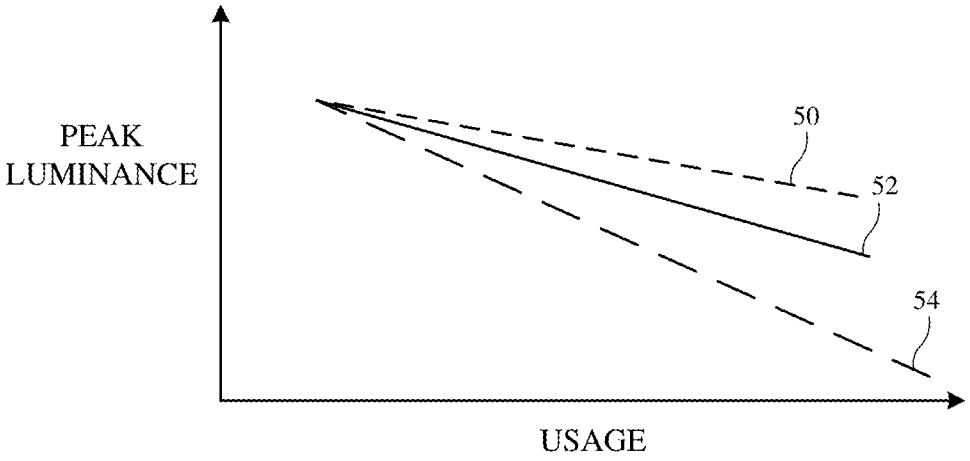
FIG. 4 is a graph of illustrative profiles of peak luminance versus usage for displays in accordance with an embodiment.

The rate at which pixels age may vary. Due to a variety of factors (e.g. conditions present during manufacturing), each display may have a unique aging rate. FIG. 4 is a graph of peak luminance as a function of usage showing this phenomenon. Profile 50 shows the aging profile of a first display in a first electronic device. Profile 52 shows the aging profile of a second display in a second electronic device. Profile 54 shows the aging profile of a third display in a third electronic device. As shown in FIG. 4, the rate at which each display ages is slightly different. At the beginning of the display's lifetime, it may be difficult to determine the precise aging profile of the display. However, as usage increases the differences in aging profiles may be detectable. An optical sensor may be included to help determine the aging profile of a particular display and compensate the pixels based on an identified aging profile.

Figure 5:
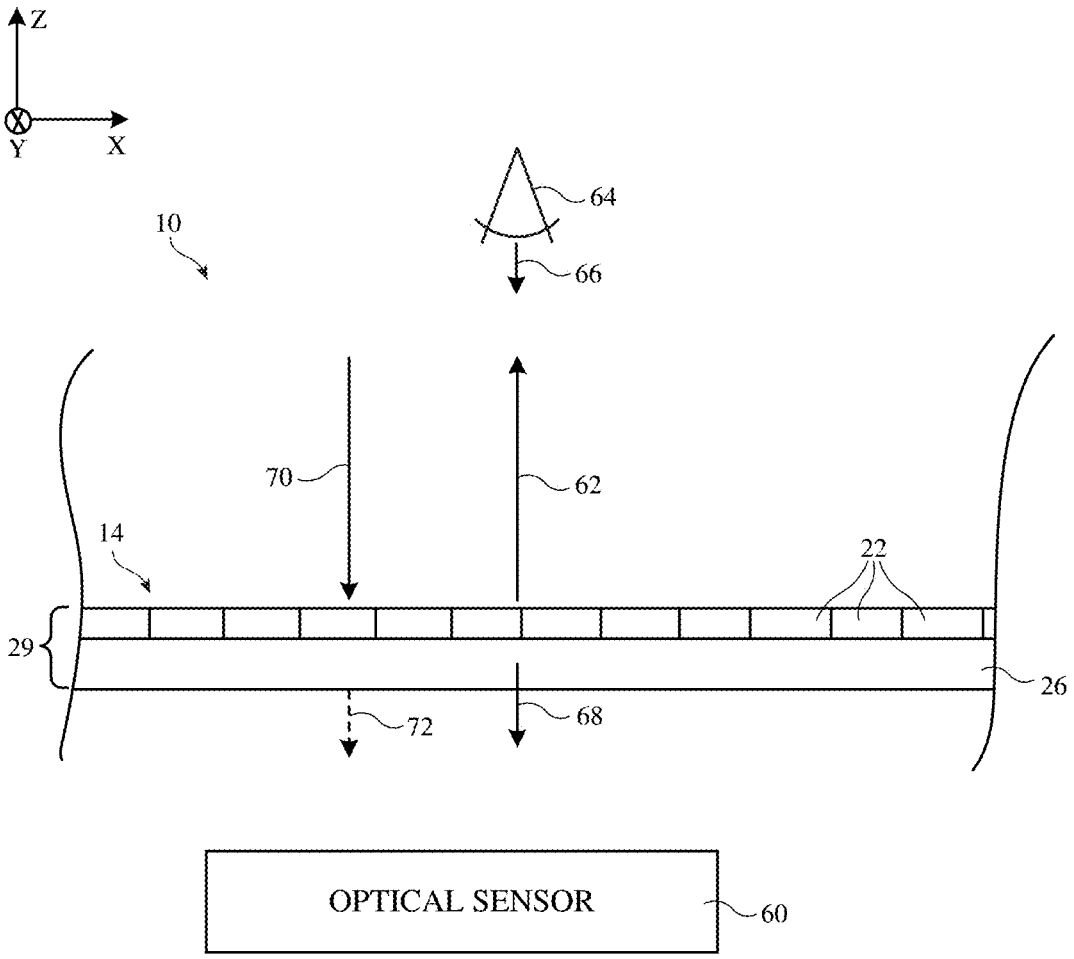
FIG. 5 is a cross-sectional side view of an illustrative electronic device that includes an optical sensor below a display panel in accordance with an embodiment.

FIG. 5 is a cross-sectional side view of an illustrative electronic device that includes an optical sensor 60 below the display. As shown, electronic device 10 includes a display 14 with pixels 22 formed on substrate 26. Substrate 26 and pixels 22 may collectively be referred to as display panel 29. Substrate 26 may include one or more glass layers, polymer layers, silicon layers, composite films that include polymer and inorganic materials, metallic foils, etc. Pixels 22 may be organic light-emitting diode (OLED) pixels or pixels of another desired type.

Pixels 22 may emit light in direction 62 (e.g., in the positive Z-direction) towards a viewer 64 who looks in direction 66 to view the display. However, pixels 22 may also emit some light in direction 68 (e.g. in the negative Z-direction). Optical sensor 60 may be positioned beneath the display panel 29. Accordingly, optical sensor 60 may detect the brightness of light emitted by the pixels in direction 68 towards the optical sensor. As the display pixels degrade over time due to wear, the pixel brightness may be tracked by optical sensor 60 for compensation purposes.

Optical sensor 60 may also be used to sense ambient light. As shown in FIG. 5, ambient light may travel in direction 70 from the exterior of the electronic device through display panel 29. Display panel 29 may block most ambient light. However, some ambient light (72) may pass through the display panel where it is sensed by optical sensor 60. The transmission of display panel 29 may be less than 20%, less than 10%, less than 5%, less than 3%, etc. However, even this small portion of the ambient light may be sufficient for optical sensor 60 to determine the brightness of ambient light around electronic device 10.

The optical sensor 60 may be a camera, proximity sensor, ambient light sensor, fingerprint sensor, or other light-based sensor. The optical sensor may include one or more photodiodes for sensing light and may optionally have more than one color channel.

During operation of the electronic device, optical sensor 60 may serve as an ambient light sensor that measures ambient light levels. This information may be used, for example, to control the overall brightness of the display (e.g., the display brightness may be increased when ambient light levels are high and the display brightness may be decreased when the ambient light levels are low). In addition, the optical sensor 60 may intermittently serve to obtain calibration data based on the brightness levels of one or more pixels 22. As previously discussed, continuous display of a single image such as watch face image 31 in FIG. 3 may result in some pixels aging faster than other pixels. Optical sensor 60 may identify the brightness differences between the pixels to characterize the pixel aging and ultimately compensate for the pixel aging.

Figure 6:
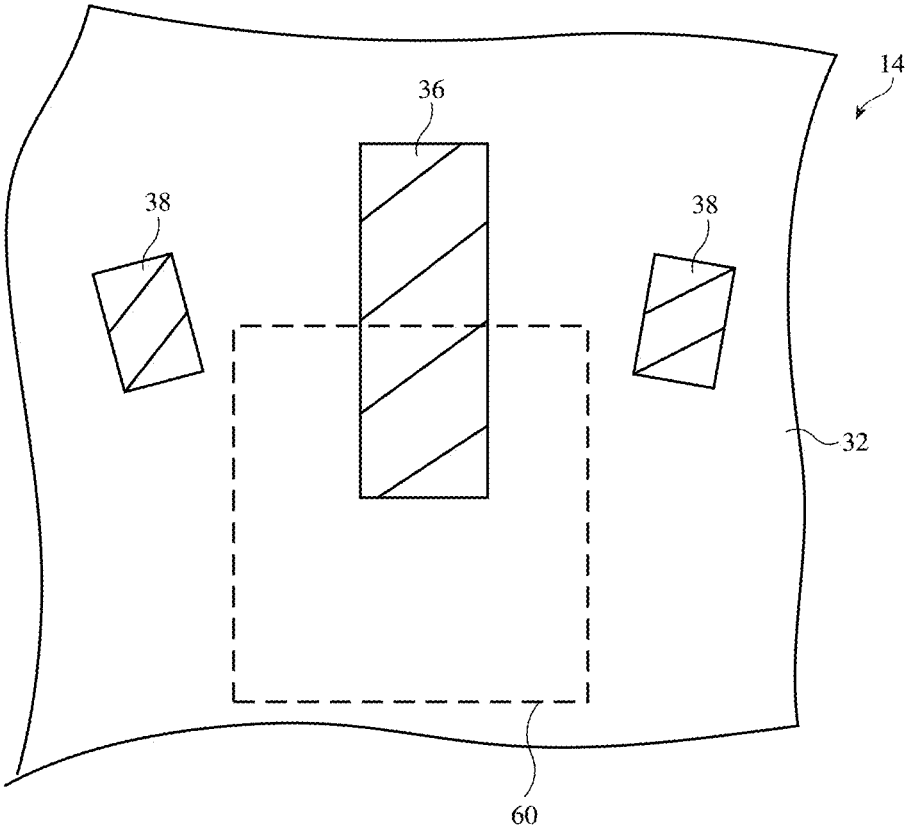
FIG. 6 is a top view of an illustrative display showing how an optical sensor may be overlapped by a watch face element in accordance with an embodiment.

FIG. 6 is a top view of a portion of display 14 where a portion of the watch face image of FIG. 3 is displayed. Specifically, an hour index 36 and two minute indices 38 are displayed in this portion of display 14. Over the lifetime of the display, the watch face image may be displayed for long periods of time. This may result in the pixels used to display hour index 36 and minute indices 38 aging more than the pixels of background 32. Therefore, after the pixels of indices 36 and 38 have aged, the display may have non-uniformities even when attempting to display a uniform image. For example, FIG. 6 may show a scenario in which the display is attempting to display a uniform white image. However, because the pixels in index regions 36 and 38 have aged more than the other pixels, the pixels in index regions 36 and 38 may be dimmer than the other pixels (as indicated by the cross-hatched areas). This causes the indices 36 and 38 to appear distinct from the background even when the display attempts to provide a uniform image. This phenomenon may be referred to as ghosting.

Optical sensor 60 may be positioned to overlap both background pixels 32 and expected high usage pixels in hour index 36. This enables the optical sensor to actively measure the brightness degradation caused by aging between the high-usage and low-usage pixels. The example of optical sensor 60 overlapping hour index 36 of the watch face image is merely illustrative. In general, optical sensor 60 may be positioned anywhere in the display that is expected to include both high-usage pixels and low-usage pixels. The optical sensor 60 may overlap any watch face element of watch face image 31, for example. Positioning optical sensor 60 to overlap both high-usage pixels and low-usage pixels allows for aging effects to be better determined by the optical sensor.

Without optical sensor 60, pixel usage information may be used to predictively compensate for pixel wear. However, the exact rate of pixel wear varies depending upon the display (as shown in connection with FIG. 4). Therefore, without optical sensor 60, the predictive compensation may be less accurate than desired and may become less accurate over time (as the usage increases and differences between the predicted aging profile and the actual aging profile increase).

With optical sensor 60, however, the optical sensor data may be used to actively detect the aging of the pixels in real time. By comparing the actual brightness of high-usage pixels to low-usage pixels that are displayed at the same target brightness level (e.g., a uniform image at peak brightness), the real time effect of aging may be measured by optical sensor 60. This real time optical sensor data may be used to compensate pixel data during operation of the display.

Figure 7:
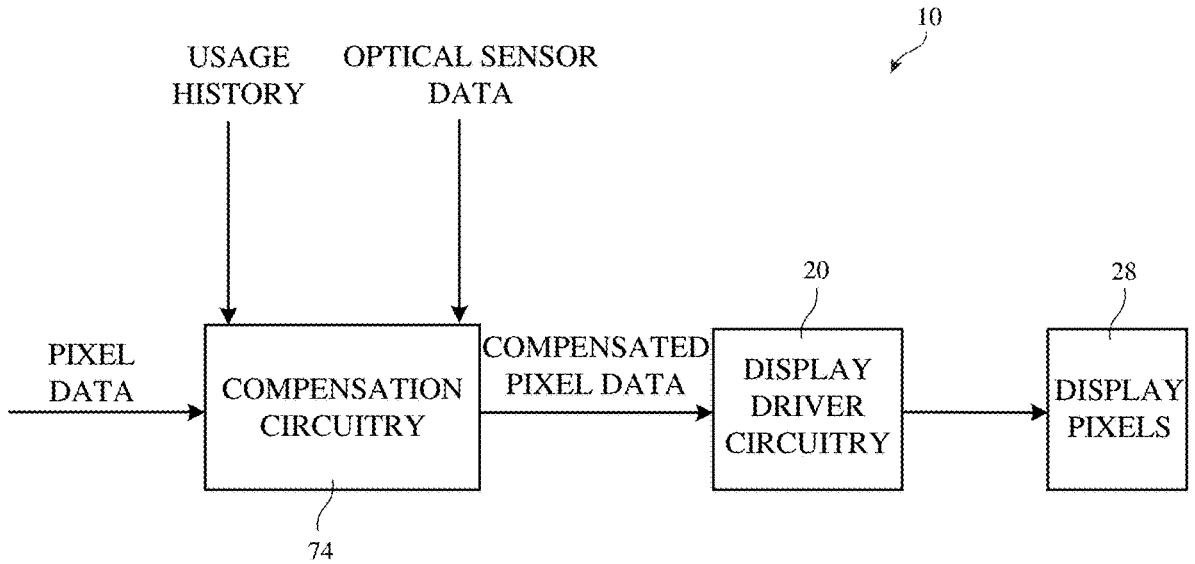
FIG. 7 is a schematic diagram of an illustrative electronic device with compensation circuitry that compensates pixel data based on usage history information and optical sensor data in accordance with an embodiment.

FIG. 7 is a schematic diagram showing how compensation circuitry may be used to compensate pixel data using pixel usage history information and optical sensor data. As shown in FIG. 7, device 10 includes compensation circuitry 74. Compensation circuitry 74 may receive pixel data as an input. The pixel data may include a respective brightness value for each pixel in the display for a given frame. The pixel data (sometimes referred to as pixel brightness values, pixel frame data, image data, etc.) may be provided by a graphics processing unit (GPU) or any other desired device component (e.g., a component in control circuitry 16). Compensation circuitry 74 may also be considered part of control circuitry 16 in FIG. 1.

In addition to the pixel data (sometimes referred to raw pixel data or uncompensated pixel data), compensation circuitry 74 receives usage history information and optical sensor data. During operation of device 10, memory in control circuitry 16 (e.g., system memory associated with an application processor, graphics processing unit memory, display driver integrated circuit memory, and/or other storage in device 10) may be used to maintain usage history information for the pixels of display 14. Pixel usage can be measured using any suitable metric. As an example, pixel usage values can be weighted as a function of luminance (e.g., a non-linear wear function or other suitable function may be used to gauge pixel wear as a function of luminance) and/or usage time (e.g., a linear function or other suitable function can be used to gauge pixel wear as a function of usage time). Ultimately, the pixel usage information may be stored in any desired memory and then provided to compensation circuitry 74, where the compensation circuitry uses the usage history information to compensate the received pixel data.

In addition to the pixel usage history information, the compensation circuitry may compensate the pixel data based on optical sensor data. The optical sensor data may be, for example, data from a testing operation in which the pixels are tested to identify the actual effects of aging between different pixels. The observed aging may be used to refine the predictive compensation that is performed using the usage history information. For example, the optical sensor data may be used to identify an aging profile for the display (e.g., one of the profiles in FIG. 4). The identified aging profile may be used to improve the efficacy of subsequent predictive compensation that is performed using the usage history information. This compensation may be local compensation that accounts for varying usage between pixels.

Optical sensor data may also be used by compensation circuitry 74 for global brightness compensation. For example, a test pattern may be displayed at the beginning of the display's lifetime and the corresponding brightness detected by the optical sensor may be stored. Then, at some later time, the test pattern may be again displayed (e.g., in a testing operation) to determine the corresponding brightness using the optical sensor. If the brightness has dropped, the magnitude of the brightness drop may be used for global brightness compensation by compensation circuitry 74.

Compensation circuitry may therefore use the usage history and/or optical sensor data to output compensated pixel data. It should be noted that the compensation circuitry may include multiple compensation blocks (e.g., a local compensation block used to account for brightness variations caused by differing pixel usage and a global compensation block used to account for global brightness drop over time). These different compensation steps may occur in parallel or in series.

The compensated pixel data from compensation circuitry 74 may be provided to display driver circuitry 20. The display driver circuitry 20 may then provide the compensated pixel data to the array of display pixels for display. The example of compensation circuitry 74 shown in FIG. 7 is merely illustrative. If desired, the compensation circuitry may be formed as part of display driver circuitry 20.

Figure 8:
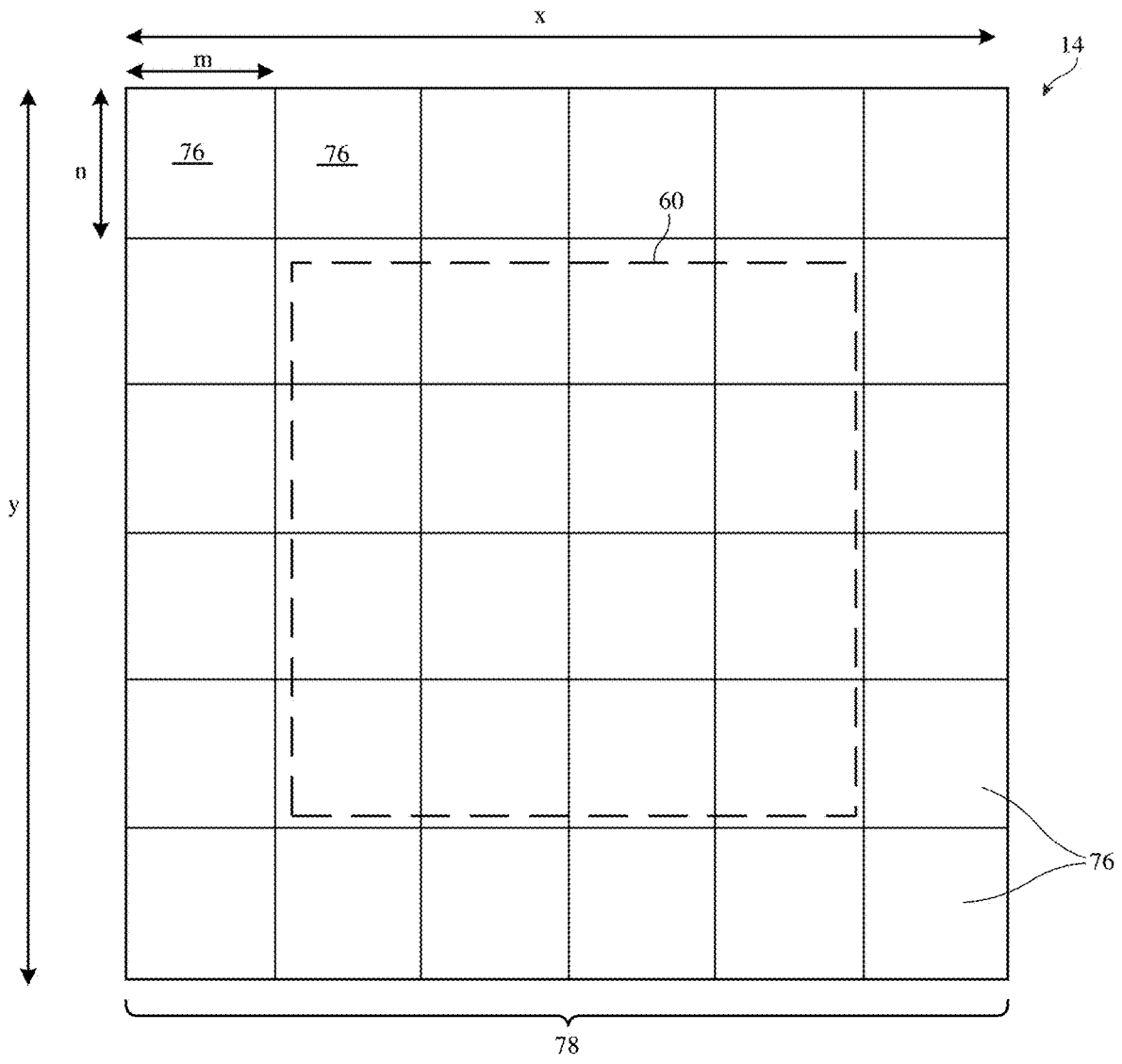
FIG. 8 is a top view of an illustrative display showing how pixel groups may sequentially emit light during a burn-in testing operation in accordance with an embodiment.

The optical sensor may be used to gather data during a pixel aging testing procedure. During the pixel aging testing procedure, one or more pixel groups may sequentially emit light while the optical sensor obtains a brightness measurement for each pixel group. FIG. 8 is a schematic diagram showing how the display may be operated during the pixel aging testing procedure.

As shown in FIG. 8, the display 14 may be divided into a plurality of pixel groups 76 in a testing area 78. Each pixel group 76 may include any desired number of pixels (e.g., m columns of pixels 22 and n rows of pixels 22). In some illustrative examples, each pixel group 76 may include a 1×1 group of pixels (e.g., 1 total pixel), a 2×2 group of pixels (e.g., 4 total pixels), a 3×3 group of pixels (e.g., 9 total pixels), a 7×7 group of pixels (e.g., 49 total pixels), a 10×10 group of pixels (e.g., 100 total pixels), etc. In general, m and n may both be equal to 1, greater than 1, greater than 2, greater than 4, greater than 6, greater than 10, greater than 50, greater than 100, etc. The magnitudes of m and n may be the same or may be different. The total number of pixels in each pixel group may be equal to 1, greater than 1, greater than 3, greater than 8, greater than 20, greater than 50, greater than 100, greater than 300, greater than 1000, greater than 2000, less than 300, between 1 and 100, etc.

Testing area 78 may include any desired number of pixel groups (e.g., x columns of pixel groups and y rows of pixel groups). Testing area 78 may include at least 2 pixel groups, at least 3 pixel groups, at least 4 pixel groups, at least 9 pixel groups, at least 16 pixel groups, at least 25 pixel groups, at least 36 pixel groups, at least 49 pixel groups, at least 100 pixel groups, between 4 and 64 pixel groups, less than 100 pixel groups, etc. In general, x and y may both be equal to 1, greater than 1, greater than 2, greater than 4, greater than 6, greater than 10, greater than 50, greater than 100, etc. The magnitudes of x and y may be the same or may be different.

The pixels in a given pixel group may emit light while all of the other pixel groups in the display are turned off. For example, the top-left pixel group may first emit light while the remaining groups are off. Optical sensor 60 may obtain a brightness measurement for the top-left pixel group while the top-left pixel group emits light. Then, the pixel group in the first row and second column may emit light while the remaining groups are off. Optical sensor 60 may obtain an associated brightness measurement for this pixel group. The pixel groups may be scanned through one by one (e.g., sequentially) until brightness measurements are obtained for each pixel group. Each row of pixel groups may be scanned one at a time from left to right moving down the testing area 78 until all of the pixel groups are tested (e.g., a raster scan may be used). This example is merely illustrative. In general, the pixel groups may be tested in any desired order.

Each pixel group may be tested individually during a testing operation for the display. It should also be noted that each pixel may have a plurality of sub-pixels (e.g., red sub-pixels, green sub-pixels, yellow sub-pixels, blue sub-pixels, white sub-pixels, etc.). In some cases, sensor 60 may not have specific color channels. Therefore, the sub-pixels may optionally be tested individually on a per-color basis. For example, consider an example where each pixel includes a red, green, and blue sub-pixel. During the testing operations, the red sub-pixels in each pixel group may be tested (e.g., a brightness measurement may be obtained by sensor 60 while the red sub-pixels in a given pixel group emit light). The blue sub-pixels in each pixel group may be separately tested. The green sub-pixels in each pixel group may be separately tested. If desired, the red, blue, and green sub-pixels in each pixel group may emit light at once to test the overall white point/brightness of the pixel.

It should also be noted that the pixel groups may include the same amount of pixels or different amounts of pixels. Previously, each pixel group was described as including the same number of pixels. However, in an alternate embodiment different pixel groups may have different numbers of pixels. The sizes of the pixel groups may depend on the position of the pixel group relative to the field of view of optical sensor 60. In general, brightness variations in pixels that directly overlap sensor 60 will be easily detected by sensor 60. However, as the separation between the pixels and the footprint of sensor 60 increases, the ability of sensor 60 to sense the pixel brightness decreases. Therefore, the pixels tested by optical sensor 60 during the testing operations may be concentrated in an area overlapping the footprint of sensor 60. As shown in FIG. 8, the testing area includes pixel groups that overlap the footprint of sensor 60 and some adjacent pixel groups that do not overlap the footprint of sensor 60.

In one illustrative example, the size of the pixel groups tested may increase with increasing distance from the optical sensor. There may be concentric rings of pixel groups, with each ring having pixel groups with more pixels with increasing distance from the optical sensor. For example, each group that overlaps the sensor may include a first number of pixels. Each group that does not overlap the sensor and is separated from the sensor footprint by a first distance may include a second number of pixels that is greater than the first number of pixels. Each group that does not overlap the sensor and is separated from the sensor footprint by a second distance that is greater than the first distance may include a third number of pixels that is greater than the second number of pixels.

Figure 9:
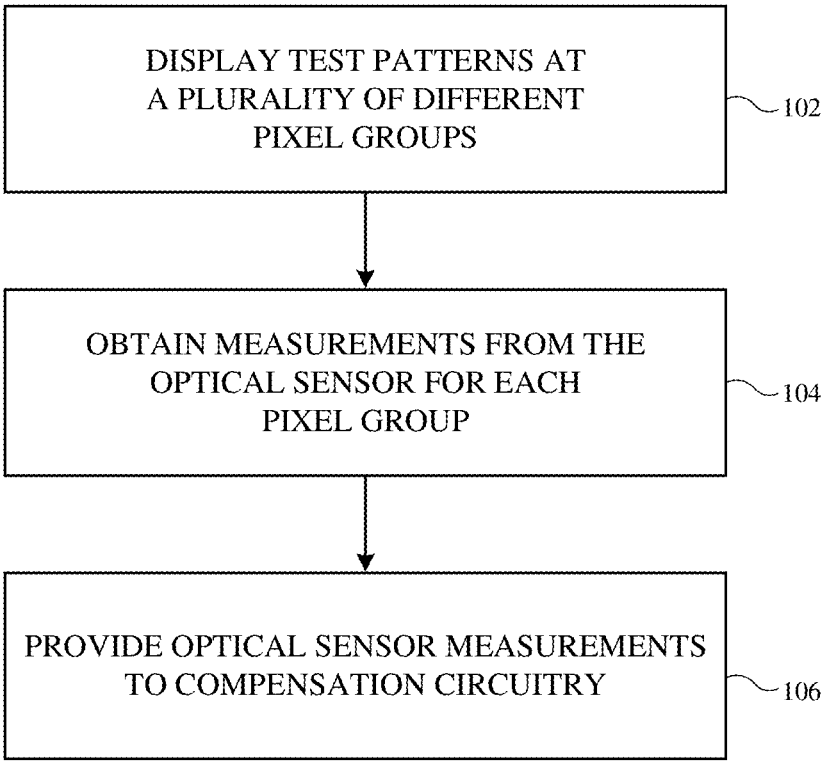
FIG. 9 is a flowchart showing illustrative method steps for operating an electronic device during a burn-in testing operation in accordance with an embodiment.

FIG. 9 is a flowchart showing illustrative method steps for a testing operation using optical sensor 60. The testing operation depicted in FIG. 9 may be used to test for differential aging between pixels in the display. A step 102, test patterns may be displayed at a plurality of different pixel groups. In other words, each pixel group (in series) may display a test pattern. The test pattern may be the same for each pixel group to allow for comparison between the pixel groups. At step 104, optical sensor 60 may obtain measurements from each pixel group while the pixel group is displaying the test pattern. Finally, at step 106, the optical sensor measurements may be provided to compensation circuitry such as compensation circuitry 74 in FIG. 7.

The optical sensor measurements provided to the compensation circuitry may include, for example, one brightness value associated with each pixel group in the testing area.

Alternatively, if multiple colors are independently tested for each pixel group, the optical sensor measurements may include multiple brightness values for each pixel group in the testing area (e.g., one red brightness value, one blue brightness value, one green brightness value, and one white brightness value for each pixel group). These optical sensor measurements may be used to quantify burn-in effects (aging affects) between pixels in the display.

The differential aging testing of FIG. 9 may be performed at any desired frequency (e.g., once every month, once every year, once every two years, between once every month and once every two years, etc.). The testing may be performed after a given amount of time passes (regardless of display usage) or after a given amount of display usage (e.g., a given number of hours of display operation). There may be a threshold (e.g., of time, display operating time) from the previous test or the beginning of the display lifetime after which the testing operations are performed. After the threshold is eclipsed, the testing operations may be performed at the next possible opportunity.

Since the display has to display the predetermined test patterns during testing operations, the differential aging testing operations (sometimes referred to as burn-in testing operations) may be performed at a time that minimizes disruption to the user. For example, the testing operations may be performed during start up or shut down of the electronic device, during a device update, as part of a user notification presented during charging of the device battery, etc. Other factors may be taken into account for determining when to perform the testing operations. For example, it may be desirable for ambient light to be below a given threshold to perform the testing operations. Control circuitry in the device may only perform the testing operations if the ambient light is below the given threshold. As another example, the testing operations may be performed based on the location of the electronic device. The testing operation may be performed when the electronic device enters a predetermined service location or when the electronic device is not located in the user's primary residence, as examples. As yet another example, the testing operations may be performed based on user instructions (e.g., user input provided using input-output devices 12).

Figure 10:
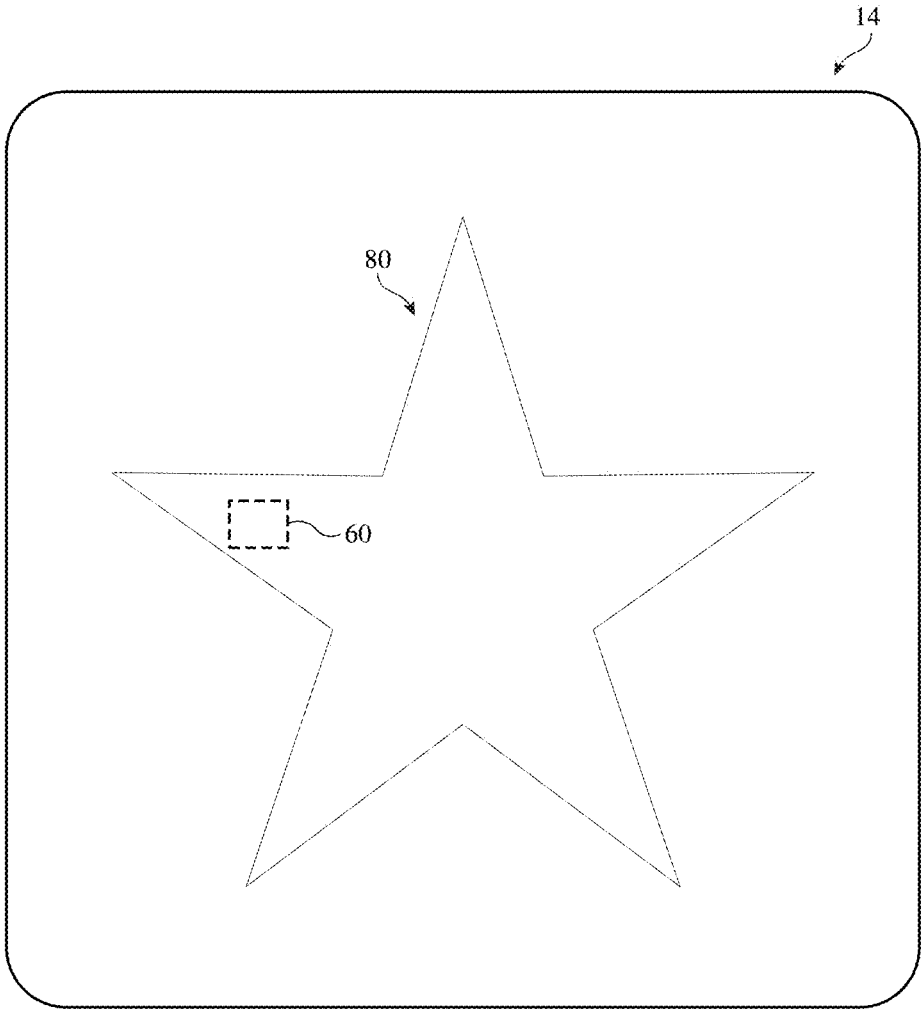
FIG. 10 is a top view of an illustrative display showing how a predetermined pattern may be displayed during a global brightness testing operation in accordance with an embodiment.

In addition to using optical sensor 60 during differential aging testing operations, the optical sensor 60 may be used during global brightness testing operations. During global brightness testing operations, a predetermined pattern 80 may be displayed on display 14, as shown in FIG. 10. Any desired predetermined pattern may be used. The ambient light sensor 60 may be overlapped by a portion of the predetermined pattern. In general, it may be desirable for the pattern to include bright pixels above the optical sensor 60 to increase the amount of light provided to the optical sensor (and correspondingly, the signal-to-noise ratio).

Figure 11:
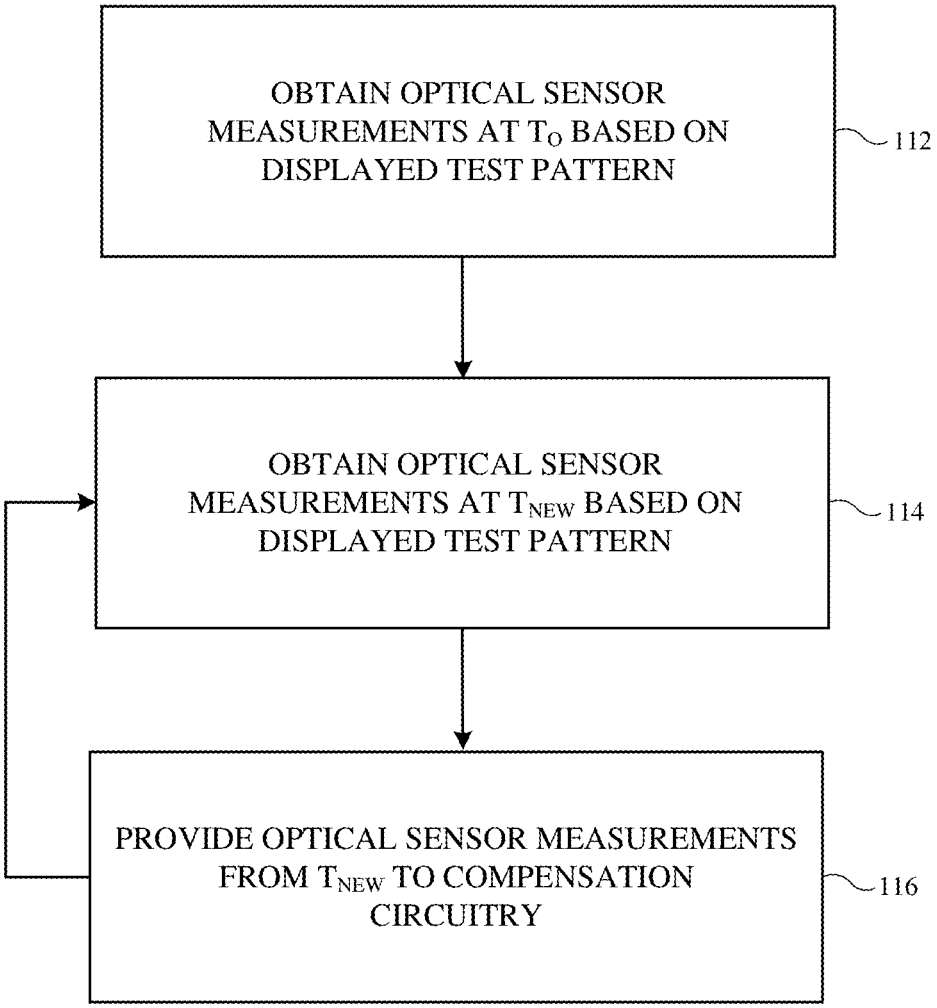
FIG. 11 is a flowchart showing illustrative method steps for operating an electronic device during a global brightness testing operation in accordance with an embodiment.

FIG. 11 is a flowchart showing illustrative method steps for a global brightness testing operation using optical sensor 60. As shown, at step 112, the optical sensor (e.g., sensor 60) may be used to obtain measurements at $T_0$ based on a displayed test pattern. In other words, the predetermined pattern may be displayed on the display and the sensor may measure the associated brightness. This test may be performed at the beginning of the lifetime of the display at $T_0$ (e.g., during the manufacturing of the display, upon initial setup of the device by a user, etc.). Then, during step 114, the sensor may obtain measurements while the same test pattern is displayed at a subsequent time $T_{NEW}$. The subsequent time $T_{NEW}$ may be after some threshold of time has passed (e.g., from a previous test). The threshold may be given either in terms of real time (e.g., one month, one year, two years, between 6 months and 2 years, between 1 month and 2 years, etc.) or in terms of display usage (e.g., a given number of hours of display operation).

Once the threshold of time has passed, the same test pattern as in step 112 may be displayed at step 114. Optical sensor measurements at $T_{NEW}$ may show whether or not there has been a decrease in display brightness between $T_0$ and $T_{NEW}$. The optical sensor data from steps 112 and/or 114 may be provided to compensation circuitry (e.g. circuitry 74 in FIG. 7) at step 116. The compensation circuitry may use the brightness changes between $T_0$ and $T_{NEW}$ to compensate for global brightness drop of the display over time.

The method may loop back to step 114 and gather additional optical sensor measurements at additional time points if desired. There may be a threshold (e.g., of time, display operating time) after which the testing operations are repeated. As examples, updated brightness data associated with the test pattern may be obtained every month, every six months, every year, every two years, between one month and two years, etc. Each time updated optical sensor measurements are obtained, the data may be provided to compensation circuitry to optimize the brightness compensation process.

Since the display has to display the predetermined test pattern during the testing operations of FIG. 11, the global brightness testing operations may be performed at a time that minimizes disruption to the user. For example, the testing operations may be performed during start up or shut down of the electronic device, during a device update, as part of a user notification presented during charging of the device battery, etc. Other factors may be taken into account for determining when to perform the testing operations. For example, it may be desirable for ambient light to be below a given threshold to perform the testing operations. Control circuitry in the device may only perform the testing operations if the ambient light is below the given threshold. As another example, the testing operations may be performed based on the location of the electronic device. The testing operation may be performed when the electronic device enters a predetermined service location or when the electronic device is not located in the user's primary residence, as examples. As yet another example, the testing operations may be performed based on user instructions (e.g., user input provided using input-output devices 12).

Figure 12:
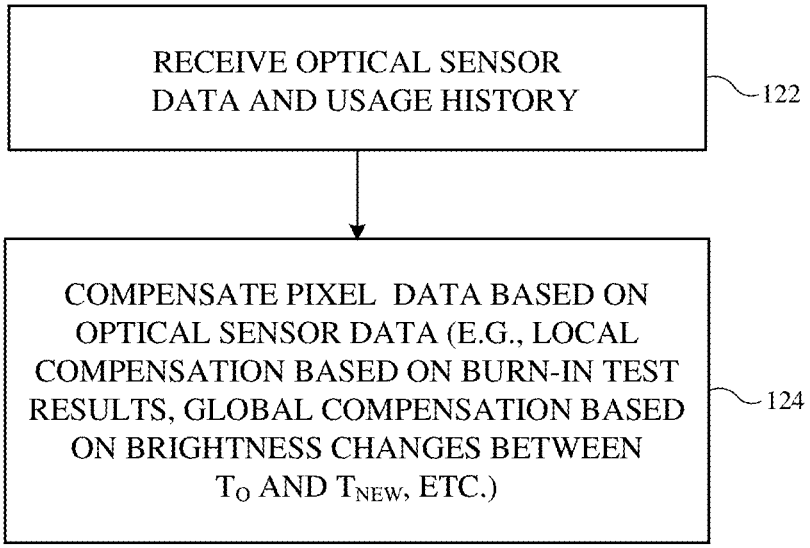
FIG. 12 is a flowchart showing illustrative method steps for operating compensation circuitry that compensates pixel data based on usage history information and optical sensor data in accordance with an embodiment.

FIG. 12 is a flowchart showing illustrative method steps for operating compensation circuitry such as compensation circuitry 74 in FIG. 12. As shown, the compensation circuitry may receive optical sensor data and usage history information at step 122. The compensation circuitry may receive the different types of data at different frequencies. For example, the usage history may be updated at a relatively high frequency (e.g., at least once every second, every ten seconds, every minute, etc.). In contrast, the optical data may be updated at a relatively low frequency. As discussed in connection with FIGS. 9 and 11, the optical data may be obtained at once a month, every six months, every year, every two years, etc.

Next, at step 124, compensation circuitry 74 may compensate pixel data using the optical sensor data (and usage history) obtained at step 122. Compensation circuitry 74 may use the optical sensor data in many ways to ultimately output compensated pixel values for the display. As one example, the compensation circuitry may use optical data from burn-in test operations for local pixel compensation. In other words, the optical data from differential aging testing operations (as shown in FIG. 9, for example) may be used to compensate different pixels by different amounts based on the usage of each pixel. As discussed in connection with FIGS. 8 and 9, the optical sensor may be able to obtain pixel aging test results from only a subset of the pixels in the display (e.g., the pixels in the field of view of the optical sensor). However, these test results may be indicative of the overall aging profile for the display (e.g., the compensation circuitry may identify a representative aging profile based on the test results). Therefore, these test results may be used to compensate all of the pixels in the display (even those not directly tested during the burn-in testing operations). Pixels not directly tested during the burn-in testing operations may still be compensated by different amounts based on the usage of the respective pixels (e.g., pixels with low usage may not be compensated or compensated by a small amount whereas pixels with high usage may be compensated by a higher amount). In other words, the optical data may be used to correlate a usage amount with a compensation amount.

As another example, the compensation circuitry may use optical data from brightness testing for global pixel compensation. In other words, the optical data from global brightness testing operations (as shown in FIG. 11, for example) may be used to compensate all of the pixels in the display. As discussed in connection with FIGS. 10 and 11, the optical sensor may be able to obtain test results from only a subset of the pixels in the display (e.g., the pixels in the field of view of the optical sensor). However, these test results may be indicative of brightness drop for the display as a whole. Therefore, these test results may be used to compensate all of the pixels in the display (even those not directly tested during the global brightness testing operations). The optical data may be used to select a global brightness compensation value that is uniformly applied to all of the pixel values.

Figure 13:
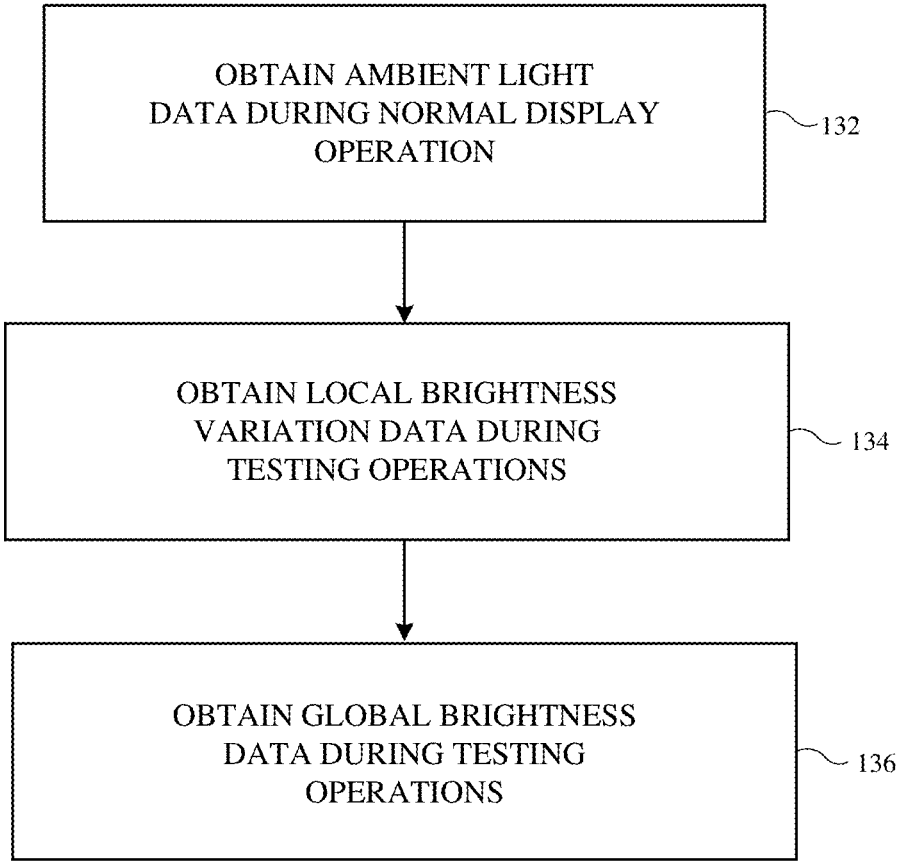
FIG. 13 is a flowchart showing illustrative method steps for operating an optical sensor during ambient light sensing and testing operations in accordance with an embodiment.

FIG. 13 is a flowchart showing illustrative method steps for operating an optical sensor such as optical sensor 60. As shown, at step 132 the optical sensor may be used to obtain ambient light data. The optical sensor may regularly obtain ambient light sensor data during operation of the display. In other words, when the display is being used to display content to the viewer (in a normal mode of operation), the optical sensor may obtain ambient light sensor data at a regular interval. The frequency at which the optical sensor obtains ambient light data may be every second, more than every second, more than every ten seconds, more than every minute, more than every 0.1 seconds, less than every 0.1 seconds, etc.

At step 134, the optical sensor may be used to obtain local brightness variation data during testing operations. The testing operations (sometimes referred to as burn-in testing operations, differential aging testing operations, pixel aging testing operations, etc.) may be performed at any desired frequency. Testing operations of the type shown in FIGS. 8 and 9 may be used, for example.

Additionally, at step 136 the optical sensor may be used to obtain global brightness data during testing operations. The testing operations (sometimes referred to as global testing operations, brightness testing operations, etc.) may be performed at any desired frequency. Testing operations of the type shown in FIGS. 10 and 11 may be used, for example.

It should be noted that the order of steps shown in FIGS. 9 and 11-13 are merely illustrative. In general, the depicted steps may be performed in any order As has been previously noted, the optical sensor may only be able to effectively obtain brightness data from pixels within the optical sensor's field of view. This may, accordingly, limit the number of pixels that are capable of being meaningfully tested within the display. Therefore, to increase the number of pixels that provide light to optical sensor 60 (and therefore the number of pixels that can be effectively tested), one or more waveguides may be incorporated into the display.

Figure 14:
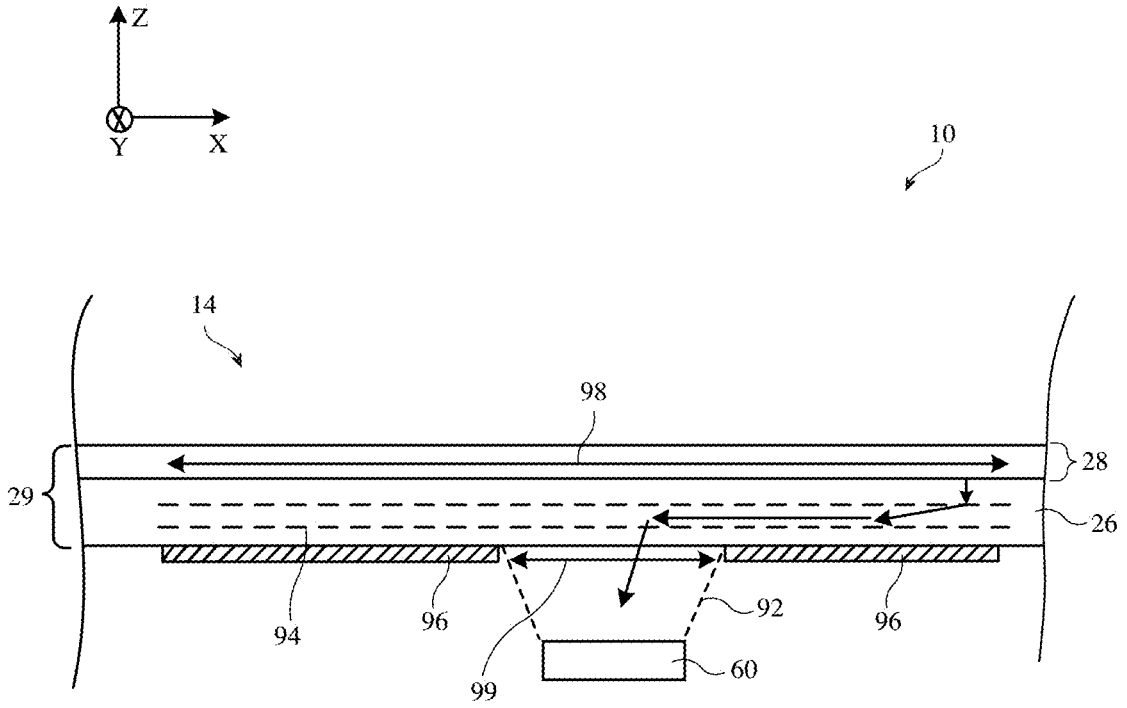
FIG. 14 is a cross-sectional side view of an illustrative electronic device that includes an optical sensor below a display panel and a waveguide to guide light to the optical sensor in accordance with an embodiment.

FIG. 14 is a cross-sectional side view of an illustrative electronic device having a display with a waveguide. As shown in FIG. 14, optical sensor 60 is formed beneath display panel 29 (similar to as shown in FIG. 5). Optical sensor 60 has a field of view 92. To direct more light into field of view 92, the display includes one or more waveguides 94. The waveguide may guide light within the XY-plane (e.g., parallel to the pixel array) towards optical sensor 60. The light may be extracted over optical sensor 60 (e.g., by light extracting elements) and directed towards optical sensor 60. The waveguides therefore redirect light from pixels that are not overlapping sensor 60 to sensor 60, increasing the capabilities of sensor 60 in testing display pixels. Light from pixels over a first area 98 (having a first width) is directed to the field of view of the optical sensor, which has a second area 99 that is smaller than the first area 98 (and that has a second width that is smaller than the first width).

Any desired components may be used to implement waveguides 94 for guiding light to optical sensor 60. The waveguides may use total internal reflection to guide light to optical sensor 60. In the example of FIG. 14, the waveguides are formed directly in display substrate 26 (e.g., the waveguides are integral with display substrate 26). In this example, the waveguide(s) may be a volumetric waveguide (e.g., a computer-generated hologram) and the substrate may be formed from a transparent polymer such as polyethylene terephthalate (PET). A reflective layer such as reflective layer 96 may also be formed on the backside of substrate 26 to encourage lateral propagation of light towards optical sensor 60. The reflective layer may be a distributed bragg reflector (also optionally formed integrally with substrate 26), may be formed from a photonic lattice, or may be formed from another desired material (e.g., a reflective metal layer). Any desired number of waveguides may be incorporated in the display.

The example in FIG. 14 of a volumetric waveguide being used is merely illustrative. Other types of waveguides may be used if desired (e.g., a fiber having a cladding and core with a refractive index difference that guides light laterally to optical sensor 60).

The foregoing is merely illustrative and various modifications can be made by those skilled in the art without departing from the scope and spirit of the described embodiments. The foregoing embodiments may be implemented individually or in any combination.

What is claimed is:

1. An electronic device comprising:

a display panel having an array of pixels formed on a substrate;

an optical sensor that is positioned beneath the display panel, wherein the optical sensor is configured to obtain pixel brightness information;

control circuitry configured to compensate brightness values for the array of pixels for a given frame based on the pixel brightness information obtained by the optical sensor; and a waveguide that is configured to guide light laterally from a pixel in the array of pixels towards the optical sensor, wherein the waveguide comprises a volumetric waveguide formed integrally with the substrate.

2. The electronic device defined in claim 1, wherein the control circuitry is configured to perform a first testing operation during which a plurality of discrete pixel groups each sequentially displays one or more test patterns.

3. The electronic device defined in claim 2, wherein the control circuitry is configured to compensate the brightness values for the array of pixels for the given frame based on brightness differences between different pixel groups of the plurality of discrete pixel groups.

4. The electronic device defined in claim 2, wherein the first testing operation is a differential aging testing operation configured to test a correlation between aging and pixel brightness.

5. The electronic device defined in claim 4, wherein the control circuitry is configured to compensate the brightness values for the array of pixels for the given frame based on the correlation between aging and pixel brightness.

6. The electronic device defined in claim 2, wherein the control circuitry is configured to perform a second testing operation during which a predetermined test pattern is displayed and a first brightness level is obtained by the optical sensor.

7. The electronic device defined in claim 6, wherein the control circuitry is configured to:

after performing the second testing operation, perform a third testing operation during which the predetermined test pattern is displayed and a second brightness level is obtained by the optical sensor.

8. The electronic device defined in claim 7, wherein the control circuitry is configured to compensate the brightness values for the array of pixels for the given frame based on a difference between the first brightness level and the second brightness level.

9. The electronic device defined in claim 8, wherein at least one month elapses between performing the second and third testing operations.

10. The electronic device defined in claim 1, wherein the optical sensor is configured to measure a brightness of ambient light that passes through the display panel.

11. An electronic device comprising:

a display panel having an array of pixels;

an optical sensor that is positioned beneath the display panel, wherein the optical sensor is configured to obtain pixel brightness information; and control circuitry configured to compensate brightness values for the array of pixels for a given frame based on the pixel brightness information obtained by the optical sensor, wherein the array of pixels is configured to display a watch face image, wherein the optical sensor is overlapped by first pixels in the array of pixels that have a first brightness while displaying the watch face image, and wherein the optical sensor is overlapped by second pixels in the array of pixels that have a second brightness that is different than the first brightness while displaying the watch face image.

12. The electronic device defined in claim 11, wherein the watch face image includes hour indices, minute indices, a central watch face element, an hour hand that moves around the central watch face element, and a minute hand that moves around the central watch face element and wherein the optical sensor is overlapped by a watch face element selected from the group consisting of: an hour index of the hour indices, a minute index of the minute indices, and the central watch face element.

13. A method of operating an electronic device having a display with pixels and an optical sensor, the method comprising:

displaying images using the display;

using the optical sensor, measuring a first brightness level of ambient light that passes through the display to the optical sensor;

performing pixel aging testing operations, wherein performing the pixel aging testing operations comprises using the optical sensor to measure a plurality of second brightness levels each associated with a different subset of pixels in the display; and performing first global brightness testing operations, wherein performing the first global brightness testing operations comprises using the optical sensor to measure a third brightness level associated with a test image; and performing second global brightness testing operations, wherein performing the second global brightness testing operations comprises using the optical sensor to measure a fourth brightness level associated with the test image and wherein at least one month elapses between performing the first and second global brightness testing operations.

14. The method defined in claim 13, wherein performing the pixel aging testing operations comprises sequentially emitting light with each subset of pixels and obtaining a corresponding second brightness level for that subset of pixels.

15. The method defined in claim 13, wherein performing the pixel aging testing operations comprises, at separate times, emitting light with at least two different sub-pixels of different colors for each different subset of pixels.

16. The method defined in claim 13, further comprising:

compensating different pixels by different amounts based on the plurality of second brightness levels from the pixel aging testing operations and based on usage history information associated with the pixels.

17. The method defined in claim 13, further comprising:

applying a global compensation to all of the pixels in the display based on the first and second global brightness testing operations.

18. The method defined in claim 13, wherein at least one year elapses between performing the first and second global brightness testing operations.

* * * * *